US010105664B2

(12) United States Patent
Hancock et al.

(10) Patent No.: US 10,105,664 B2
(45) Date of Patent: Oct. 23, 2018

(54) RECIPROCATING TUBE-SHAKING MECHANISMS FOR PROCESSING A MATERIAL

(71) Applicant: OMNI INTERNATIONAL, INC., Kennesaw, GA (US)

(72) Inventors: John Hancock, Atlanta, GA (US); Thomas Gray, Canton, GA (US); Spencer Smith, Marietta, GA (US); Voya Vidakovic, Marietta, GA (US); Alan Vaughn, Dallas, TX (US)

(73) Assignee: OMNI INTERNATIONAL, INC., Kennesaw, GA (US)

( * ) Notice: Subject to any disclaimer, the term of this patent is extended or adjusted under 35 U.S.C. 154(b) by 199 days.

(21) Appl. No.: 14/926,731

(22) Filed: Oct. 29, 2015

(65) Prior Publication Data

US 2016/0121278 A1 May 5, 2016

Related U.S. Application Data

(60) Provisional application No. 62/072,655, filed on Oct. 30, 2014.

(51) Int. Cl.
*B01F 11/00* (2006.01)

(52) U.S. Cl.
CPC ..... *B01F 11/0005* (2013.01); *B01F 11/0008* (2013.01); *B01F 11/0022* (2013.01); *B01F 2215/0037* (2013.01)

(58) Field of Classification Search
CPC ..... B01F 11/0005; B01F 11/0008; B01F 11/0022; B01F 2215/0037
USPC ..... 366/212, 215, 216, 217
See application file for complete search history.

(56) References Cited

U.S. PATENT DOCUMENTS 67,095 A * 7/1867 Arnall ..... B01F 11/0005 366/215
118,664 A * 8/1871 Yeager ..... B01F 11/0005 366/215
140,280 A * 6/1873 Keeler ..... B01F 9/0025 366/216
230,687 A * 8/1880 Baldwin ..... B01F 9/0025 366/216
303,080 A * 8/1884 Wissenborn ..... B01F 11/0022 366/212

(Continued)

*Primary Examiner* — Tony G Soohoo
(74) *Attorney, Agent, or Firm* — Gardner Groff Greenwald & Villanueva, PC

(57) ABSTRACT

Agitation mechanisms for homogenization devices for processing sample materials in tubes that are secured by tube holders to the agitation mechanisms. Each agitation mechanism includes a first rotary member having a first fixed rotational axis, a second rotary member having a second fixed rotational axis, and a connecting member that extends between them, is rotationally mounted to them at third and fourth non-fixed rotational axes, and to which the tube holder is mounted, with the first and third rotational axes defining a first offset, and with the second and fourth rotational axes defining a second offset. When the first rotary member is driven through rotation, the sample in the tube in the tube holder on the connecting member is driven through a nonlinearly reciprocating motion profile to produce a grinding shear action to better homogenize the samples. Other disclosed embodiments produce linearly reciprocating motion profiles.

11 Claims, 18 Drawing Sheets

(56) References Cited

U.S. PATENT DOCUMENTS 390,974 A * 10/1888 Jennings ..... B01F 11/0022 366/212
391,150 A * 10/1888 Jennings ..... B01F 11/0022 366/212
392,865 A * 11/1888 Kanable ..... B01F 11/0008 366/110
639,404 A * 12/1899 Kolls ..... B01F 11/0022 366/212
791,664 A * 6/1905 Wilson ..... B01F 11/0022 366/209
985,040 A * 2/1911 Lillienthal ..... B01F 11/0022 366/212
1,015,383 A * 1/1912 Dyer ..... B01F 11/0022 366/212
1,242,218 A * 10/1917 McCann ..... B01F 11/0022 366/212
1,329,843 A * 2/1920 Meguiar ..... B01F 11/0022 366/212
1,365,963 A * 1/1921 Brown ..... A01J 15/04 366/210
RE15,677 E * 8/1923 Brown et al. ..... A01J 15/04 366/215
1,486,266 A * 3/1924 Rosenblatt ..... B01F 11/0022 366/212
1,527,227 A * 2/1925 Sanders ..... A47J 43/042 366/212
1,704,010 A * 3/1929 Manon ..... B01F 11/0022 366/212
2,146,860 A * 2/1939 Shaw ..... A47J 43/042 366/212
2,345,130 A * 3/1944 Latham ..... B01F 11/0022 366/215
2,673,722 A * 3/1954 Griffin ..... B01F 11/0022 366/212
3,198,502 A * 8/1965 Thompson ..... B01F 11/0022 210/388
3,437,317 A * 4/1969 Micin ..... A47J 43/042 366/211
5,608,693 A * 3/1997 Richards ..... B01F 11/0005 366/114
5,697,701 A * 12/1997 Forrest ..... B01F 11/0031 366/110
8,889,406 B2 * 11/2014 van der Heiden .. B01F 11/0025 366/211
2012/0263010 A1 * 10/2012 Boquet ..... B01F 11/0008 366/110
2013/0003487 A1 * 1/2013 Ballard ..... B01F 11/0008 366/110
2014/0072474 A1 3/2014 Kido et al.
2014/0126321 A1 * 5/2014 Eisen ..... B01F 15/00409 366/213
2014/0212336 A1 7/2014 Kido et al.
2016/0121278 A1 * 5/2016 Hancock ..... B01F 11/0005 366/215

* cited by examiner

140

RECIPROCATING TUBE-SHAKING MECHANISMS FOR PROCESSING A MATERIAL

CROSS-REFERENCE TO RELATED APPLICATION

This application claims the priority benefit of U.S. Provisional Patent Application Ser. No. 62/072,655, filed Oct. 30, 2014, which is hereby incorporated herein by reference.

TECHNICAL FIELD

The present invention relates generally to laboratory devices for homogenizing sample materials, and particularly to reciprocating mechanisms for inclusion in homogenizing devices to generate reciprocal agitation motions and forces on the samples.

BACKGROUND

Homogenization involves disaggregating or emulsifying the components of a sample using a high-shear process with significant micron-level particle-size reduction of the sample components. Homogenization is commonly used for a number of laboratory applications such as creating emulsions, reducing agglomerate particles to increase reaction area, cell destruction for capture of DNA material (proteins, nucleic acids, and related small molecules), DNA and RNA amplification, and similar activities in which the sample material is bodily tissue and/or fluid, or another substance. Conventional high-powered mechanical-shear homogenization devices for such applications are commercially available in various designs to generate for example vigorous reciprocating, circular, or "swashing" (sinusoidal) oscillating motions and resulting forces. The samples are held in sample tubes that are mounted to tube holders that are mounted to the homogenization device such that the vigorous oscillating forces are transmitted through the tube holders and the tubes to the contained samples.

These homogenization devices have proven generally beneficial in accomplishing the desired homogenization of the sample materials. But in use they have their disadvantages. For example, the linear reciprocating motion tends to produce less of a grinding shear action on the samples and instead merely causes the samples to linearly traverse the lengths of the tubes (with little disaggregation) and smash against the ends of the tubes (with the impacts causing disaggregation). In addition, these impacts tend to create a lot of heat in the tubes, which can degrade the samples to be processed.

Accordingly, it can be seen that needs exist for improvements in reciprocating mechanisms of homogenization devices to provide better homogenization of the sample materials. It is to the provision of solutions to this and other problems that the present invention is primarily directed.

SUMMARY

Generally described, the present invention relates to agitation mechanisms for homogenization devices for processing sample materials in tubes that are secured by tube holders to the agitation mechanisms. Each agitation mechanism includes a first rotary member having a first fixed rotational axis, a second rotary member having a second fixed rotational axis, and a connecting member that extends between them and is rotationally mounted to them at third and fourth non-fixed rotational axes, with the tube holder mounted to the connecting member (or the second rotary member), with the first and third rotational axes defining a first offset, and with the second and fourth rotational axes defining a second offset. When the first rotary member is driven through rotation, the sample in the tube in the tube holder on the connecting member is driven through a nonlinearly reciprocating motion profile to produce a grinding shear action to better homogenize the samples.

In some embodiments, the first and second offsets are different to produce a nonlinearly reciprocating motion profile of a centroid of the tube that is not symmetrical about a transverse axis of the tube. In other embodiments, the first and second offsets are substantially equal to produce a nonlinearly reciprocating motion profile of a centroid of the tube that is symmetrical about a transverse axis of the tube. And in yet other embodiments, the second rotary member is eliminated and replaced with a linear slide carriage to which the tube holder is mounted to produce a linearly reciprocating motion profile of a centroid of the tube.

The specific techniques and structures employed to improve over the drawbacks of the prior devices and accomplish the advantages described herein will become apparent from the following detailed description of example embodiments and the appended drawings and claims.

DESCRIPTION OF EXAMPLE EMBODIMENTS

Figure 1:
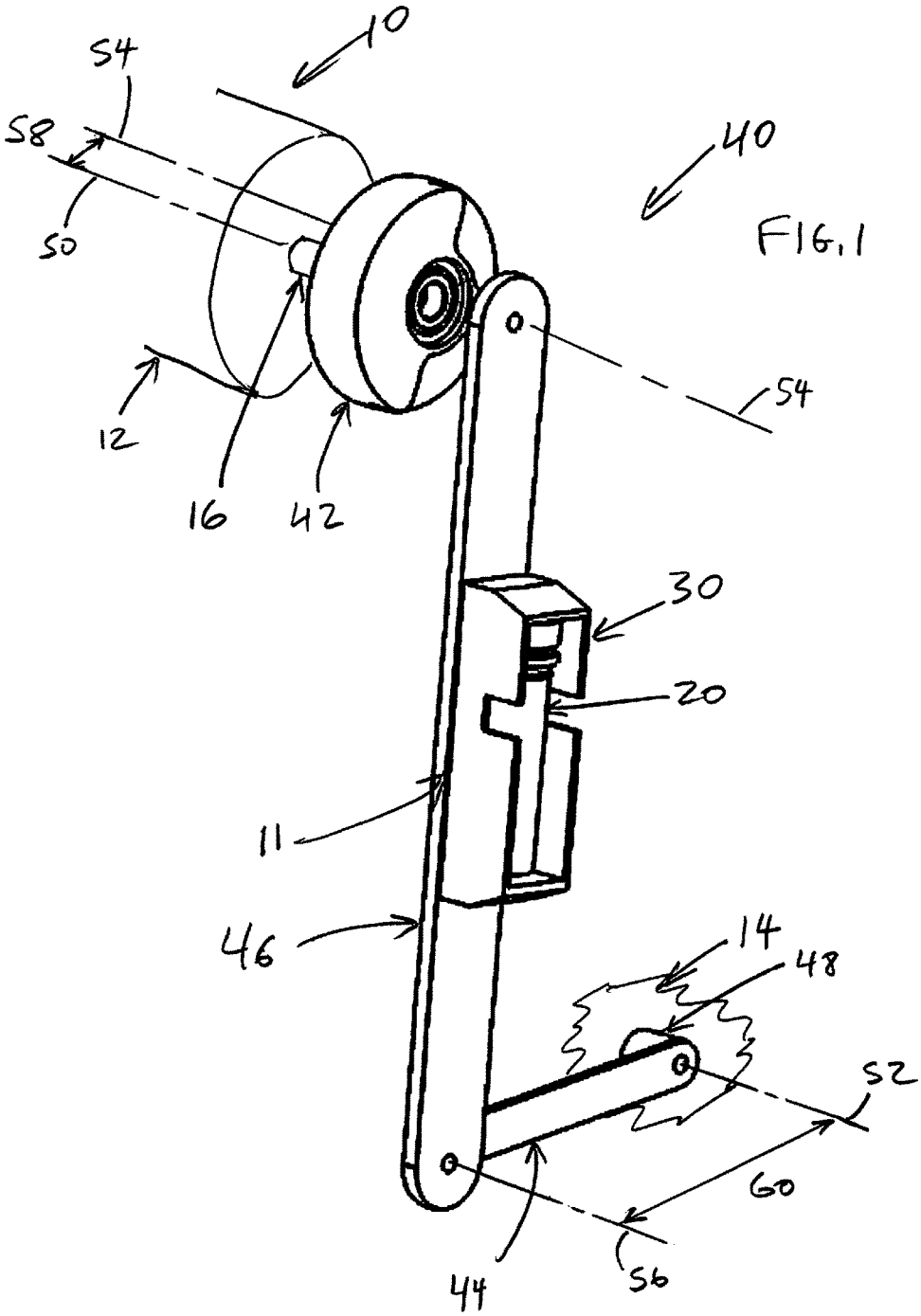
FIG. 1 is a perspective view of an agitation mechanism according to a first example embodiment of the present invention, showing a portion of a homogenization device its incorporated into, a tube holder mounted to it, and a sample-holding tube mounted to the tube holder.
Figure 2:
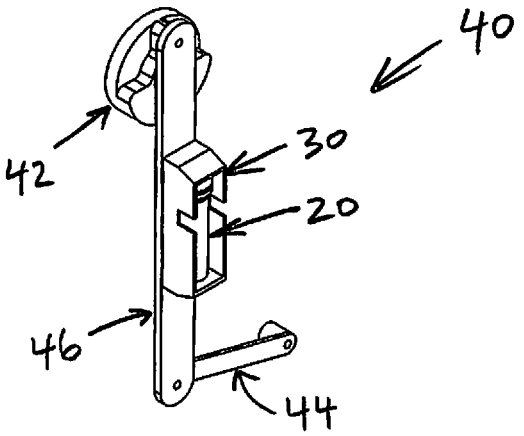
FIG. 2 shows the agitation mechanism of FIG. 1 in use with the crank member in a 12 o'clock position.
Figure 3:
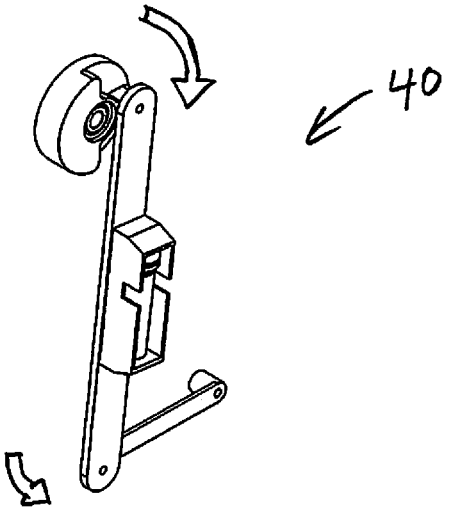
FIG. 3 shows the agitation mechanism of FIG. 2 in use with the crank member rotated to a 3 o'clock position.
Figure 4:
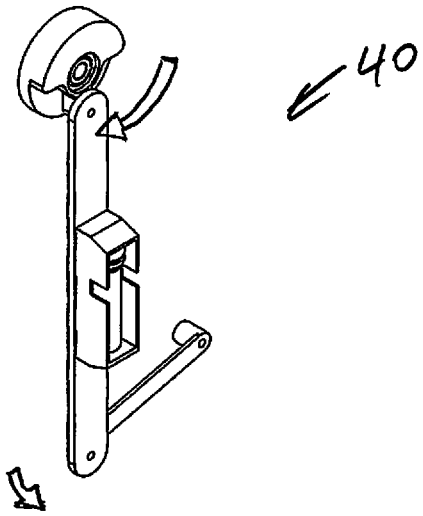
FIG. 4 shows the agitation mechanism of FIG. 3 in use with the crank member rotated further to a 6 o'clock position.
Figure 5:
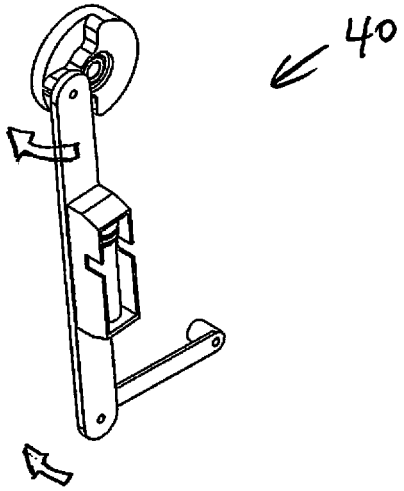
FIG. 5 shows the agitation mechanism of FIG. 4 in use with the crank member rotated further to a 9 o'clock position.
Figure 6:
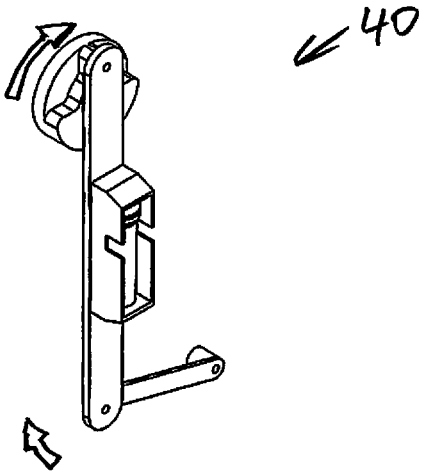
FIG. 6 shows the agitation mechanism of FIG. 5 in use with the crank member rotated further back to the 12 o'clock position.
Figure 7:
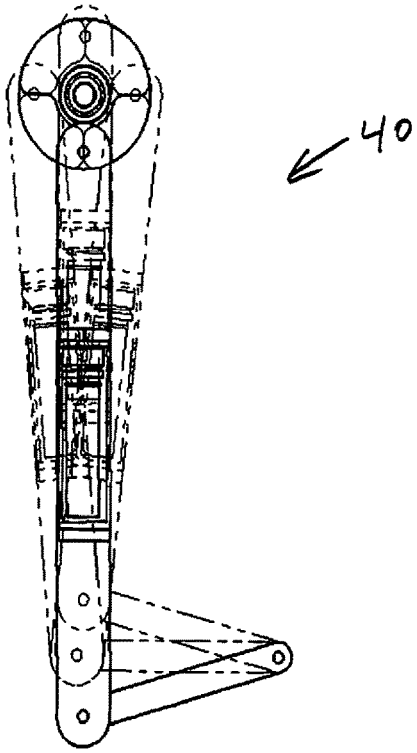
FIG. 7 is a side view of the agitation mechanism of FIG. 1, with the four positions of FIGS. 2-6 shown in phantom lines.
Figure 8:
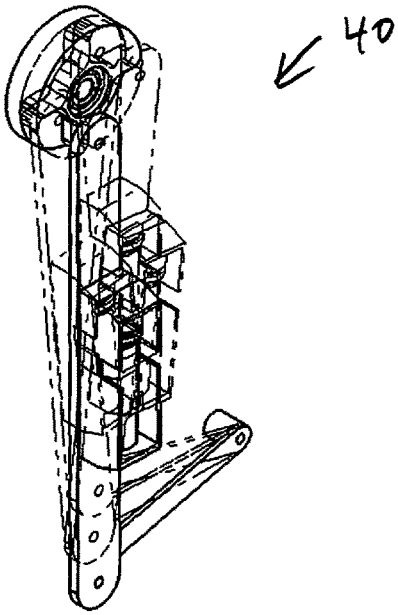
FIG. 8 is a perspective view of the agitation mechanism of FIG. 7.

The present invention relates primarily to agitation mechanisms of homogenization devices for generating nonlinearly reciprocating motions and resulting forces on tubes mounted to the device and thus to samples contained in the tubes. By the use of the agitation mechanisms, the nonlinearly reciprocating forces on the samples in the tubes tend to cause the samples to move not just back and forth between the ends of the tubes (i.e., along the axial lengths of the tubes) but also somewhat transversely (i.e., laterally) back and forth between the sides of the tubes (i.e., across the widths of the tubes) to produce a grinding shear action to better homogenize the samples and to avoid excess heat generation.

It should be noted that the agitation mechanisms can be used with a wide variety of different types of homogenization devices, tube holders, tubes, and sample materials, and as such these terms as used herein are intended to be broadly construed. Accordingly, the term "homogenizing device" includes shakers, bead mills, vortexers, centrifuges, other sample-agitation devices, and other devices for processing samples by generating and applying vigorous oscillating agitation forces, for laboratory and/or other applications. The term "processing" means particle-size reduction of the sample by use of one or more of the homogenizing devices disclosed herein or known to persons of ordinary skill in the art. The term "tube holder" includes any plate, clamp, clip, cassette, or other retaining structure that can hold one or more sample tubes during homogenization. The term "tube" includes any sealable vessel or container that can hold a sample during homogenization and is not necessarily limited to conventional clear, plastic, cylindrical vials. And the term "sample" includes any type of substance that can be homogenized and for which homogenization could be useful, such as but not limited to human or non-human bodily fluid and/or tissue (e.g., blood, bone-marrow cells, a coronary artery segment, or pieces of organs), other organic matter (e.g., plants or food), and/or other chemicals.

Turning now to the drawings, FIGS. 1-9 show a nonlinearly reciprocating agitation mechanism 40 according to a first example embodiment of the invention. The agitation mechanism 40 can be readily incorporated into a conventional homogenization device 10, as is understood by persons of ordinary skill in the art, to transmit nonlinearly reciprocating motions and resulting forces through a tube holder 30 holding a tube 20 containing a sample material to homogenize the sample. In typical embodiments, the homogenization device 10 includes a drive system (e.g., an electric rotary motor 12) for driving the agitation mechanism 40, an electric power source or connection (e.g., a power cord) for powering the drive system, a control system (e.g., a programmed controller, inputs such as buttons and a keypad, and outputs such as a display screen, for functions such as on/off, start/stop, speed, and time) for operating the drive system, and a housing and/or frame 14 that at least partially encloses and/or supports the agitation mechanism, the drive system, and the control system. These major components of the homogenization device can be of a conventional type well known in the art, so exacting details are not included herein.

The agitation mechanism 40 includes a first rotary member 42, a second rotary member 44, and a connecting member 46 that extends between them and to which the tube holder 30 is mounted. One of the first and second rotary members 42 and 44 is operably coupled to a rotary drive/output shaft 16 of the drive system 12 of the homogenizer 10 at a first fixed rotational axis 50, with this rotary member also referred to as the crank member. And the other one of the first and second rotary members 42 and 44 is rotationally mounted in a fixed location for example by a pin 48 to the housing or frame 14 of the homogenizer 10 at a second fixed rotational axis 52, with this rotary member also referred to as the rocker member. In the depicted embodiment, for example, the first rotary member 42 is the crank member and the second rotary member 44 is the rocker member.

The crank and rocker rotary members 42 and 44 can be provided by various different structures, including wheels (e.g., solid disks or peripheral-frame hoops), wedges (i.e., portions of wheels), link arms (e.g., flat, thin blades), or other conventional rotary structures. And the connecting member 46 can be provided by various different structures, including link arms (e.g., flat, thin blades), rods, bars, plates, panels, or other conventional structures for rotationally connecting two parts. In the depicted embodiment, for example, the crank member 42 is a wheel, the rocker member 44 is a link arm, and the connecting member 46 is a link arm.

The connecting member 46 is rotationally coupled (e.g., by rotation-permitting pins) to the crank and rocker rotary members 42 and 44 at third and fourth non-fixed rotational axes 54 and 56, respectively. The crank and rocker rotary members 42 and 44 have different diameters of rotation. (As used herein, the pivoting motion of the rocker rotary member is considered to be rotational because it forms a curve even though not a complete 360-degree curve.) In other words, the third rotational axis 54 is offset from the first rotational axis 50 by a crank offset 58, and the fourth rotational axis 56 is offset from the second rotational axis 52 by a rocker offset 60, with the crank and rocker offsets not being equal. The rocker offset 60 is sufficiently longer (e.g., about three times longer in the depicted embodiment) than the crank offset 58 that the third rotational axis 54 curves through a complete 360-degree path around the first rotational axis 50 with a constant angular speed, while the fourth rotational axis 56 sweeps back and forth through an arc (with a longitudinal component and a transverse component) radiused from the second rotational axis 52 with cyclically increasing and decreasing angular speeds, and while the sample in the tube 20 is subjected to cyclically increasing and decreasing angular speeds (and resulting acceleration and deceleration forces) due to mechanically imparted forces due to the transverse motion component (and resulting transverse forces) of the nonlinear reciprocation.

The tube holder 20 can be designed to hold one tube 30 (as depicted) or multiple tubes. The tube holder 20 can be fixedly or removably mounted to the agitation mechanism 10 at a mounting location 11 by conventional mounting structures such as pins, rivets, adhesives, clamps, etc. In the depicted embodiment, the tube holder 20 is mounted at a mounting location 11 on the connecting member 46 to move in a parallel (including the same) plane, and is generally aligned with the third and fourth non-fixed rotational axes 54 and 56. In other embodiments, the tube holder is mounted at a mounting location on the rocker member to move in a parallel (including the same) plane. Typically, the tube holder 20 includes clamping or other retention structures that grip the tube 30 to releasably hold it in place with a snap fit. The tube holder 20 can be of a conventional type well known in the art, so exacting details are not included herein. In some embodiments, the tube holder is of the type disclosed in U.S. patent application Ser. No. 14/884,989 filed Oct. 16, 2015, which is hereby incorporated herein by reference. In other embodiments, the tube holder and the connecting member (or the second member) are integrally formed as a single piece.

FIGS. 2-6 show the use of the agitation mechanism 40 of the homogenization device 10 to process a sample material in one cycle of reciprocation, with the crank member 42 being driven through a complete 360-degree rotational cycle (as indicated by the upper angular directional arrows) from the 12 o'clock position (FIG. 2), to the 3 o'clock position (FIG. 3), to the 6 o'clock position (FIG. 4), to the 9 o'clock position (FIG. 5), and back to the 12 o'clock position (FIG. 6) to drive the rocker member 44 through its rocking motion (as indicated by the lower angular directional arrows). And FIGS. 7 and 8 each show this same one cycle of reciprocation in one view (so the four positions shown in phantom lines in each of FIGS. 7 and 8 correspond to the four positions of FIGS. 2/6, 3, 4 and 5).

In particular, the control system is operated to rotate the drive shaft 16 of the drive system 12, which in turn rotates the crank wheel 42 of the agitation mechanism 40. This rotation is transmitted from the crank wheel 42, through the connection arm 46, to the rocker arm 44. As the crank wheel 42 rotates, the connection arm 46 and rocker arm 44 rotationally pivot back and forth to create the depicted nonlinear, reciprocating, planar motion profile (i.e., traced path of travel) 62 (see FIG. 9) for a centroid (i.e., the geometric center in all three axes) 22 of the tube 20 (i.e., the internal sample-containing chamber) in the tube holder 30. The motion profile 62 of the tube centroid 22 is generally oval or teardrop-shaped, with the upper portion of the motion profile being (relatively slightly) more elliptical/circular/bulbous than the lower portion, which is (relatively slightly) more linear/narrow than the upper portion (so a motion profile of the tube top centroid is more elliptical that a motion profile of the tube bottom centroid, which is more linear than the tube top centroid motion profile). Thus, the motion profile 62 is substantially symmetrical about the longitudinal axis of the tube (including the right side of the depicted motion profile being slightly flatter with the left side being slightly rounder, relatively speaking) but not substantially symmetrical about the transverse axis of the tube 20. (The motion prone 62 is substantially but not perfectly symmetrical about the vertical/longitudinal axis because the rocker arm 44 pivots back and forth through a slight are radiused about the rotational axis 52 of the rocker arm, so the motion profile is slightly rounder on the left side and slightly flatter on the right side.) The crank wheel 42 and the rocker arm 44 propel the connection arm 46 in a plane perpendicular to the rotational axes 50 and 52 of the crank wheel and the rocker arm, and as such the sample tube 20 is always parallel to that perpendicular plane. As such, the agitation mechanism 40 advantageously uses a planar quadrilateral linkage system with four rotating joints 50, 52, 54, and 56 to define this unique motion profile 62 with a non-linear path of reciprocating motion that provides for improved grinding characteristics and increased acceleration forces for more-effective processing.

Figure 9:
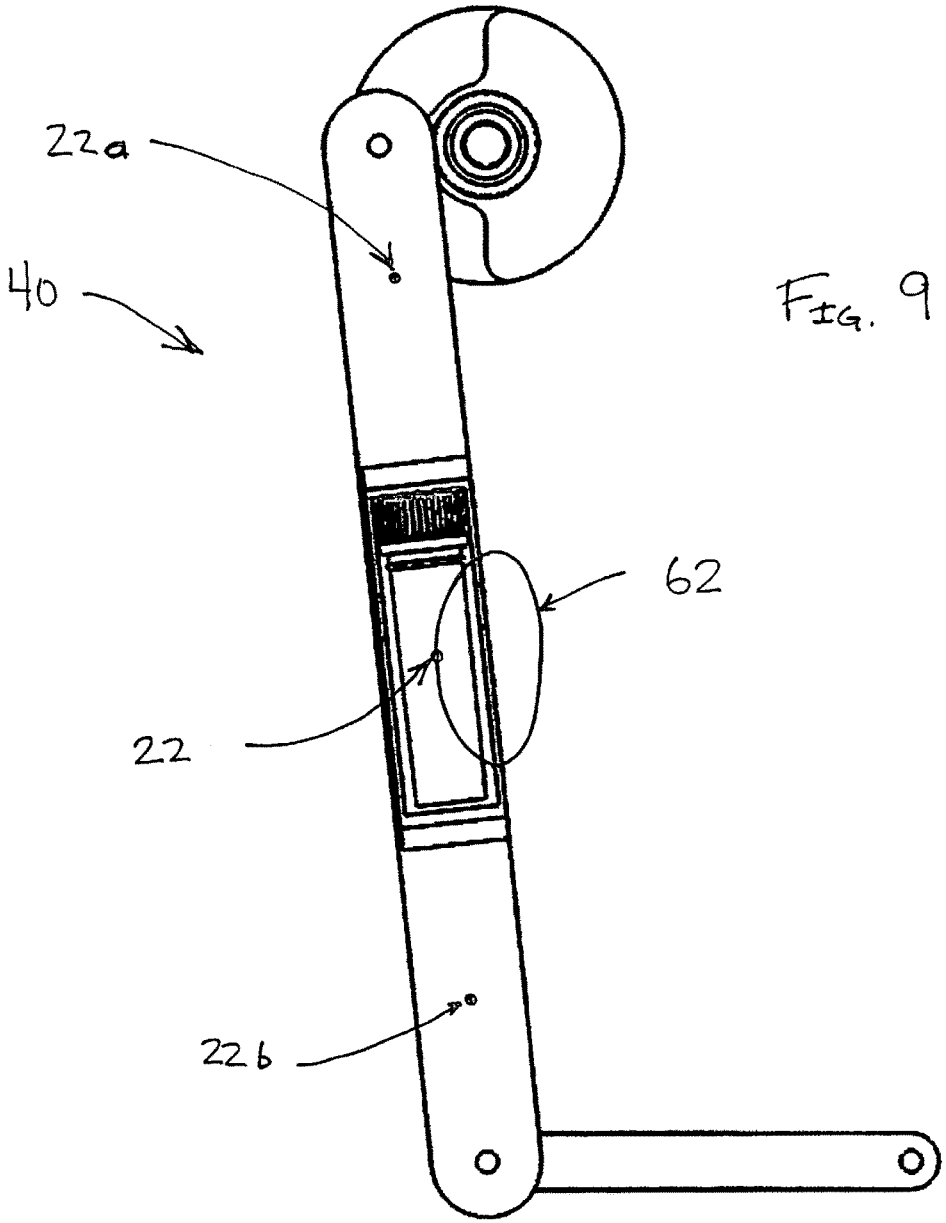
FIG. 9 is a side view of the agitation mechanism of FIG. 1, showing a motion profile traced as a centroid of the tube moves through the four positions of FIG. 7.
Figure 9A:
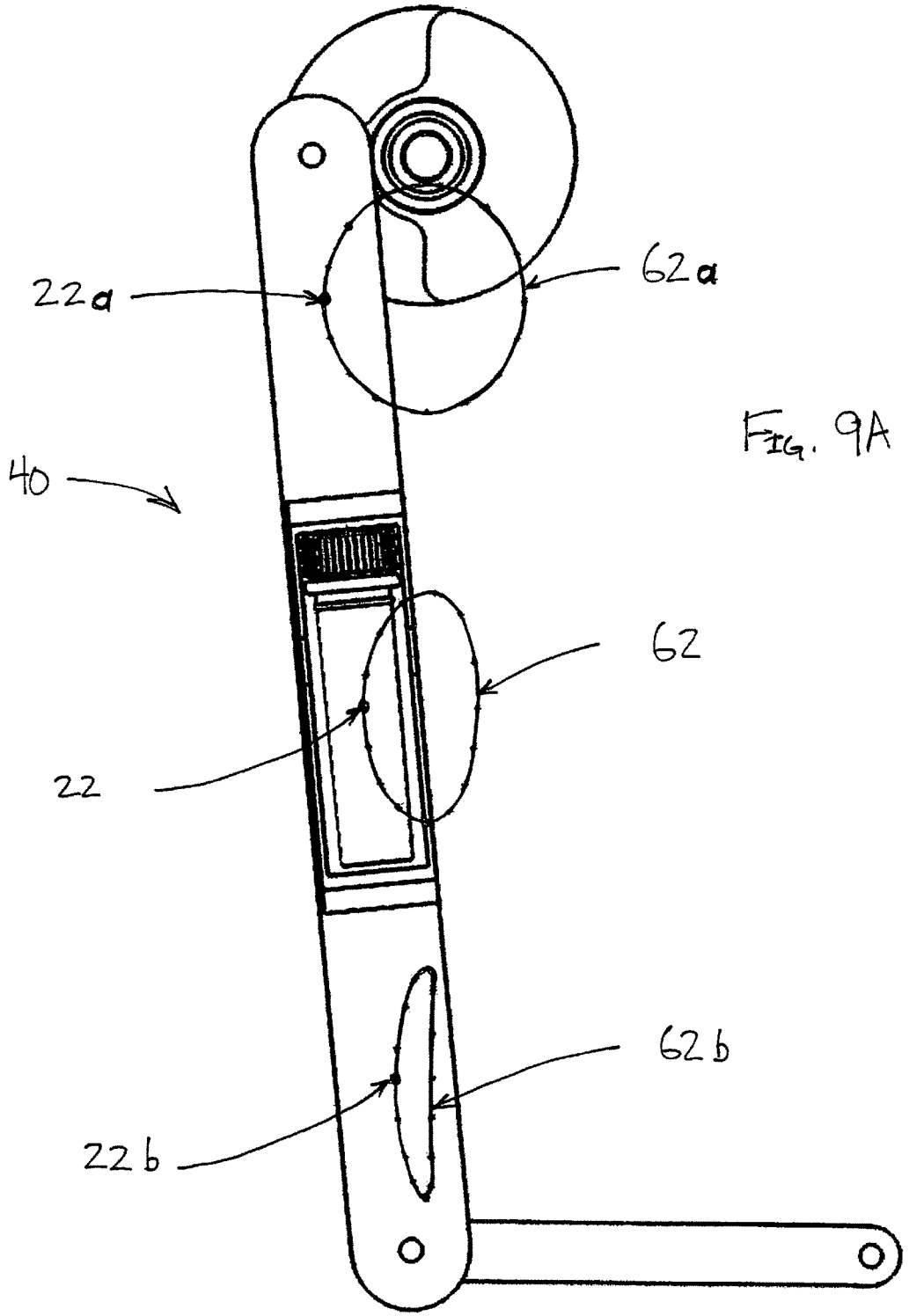
FIG. 9A shows the agitation mechanism of FIG. 9 with two alternative locations for the tube centroid for producing two alternative agitation motion profiles.
Figure 10:
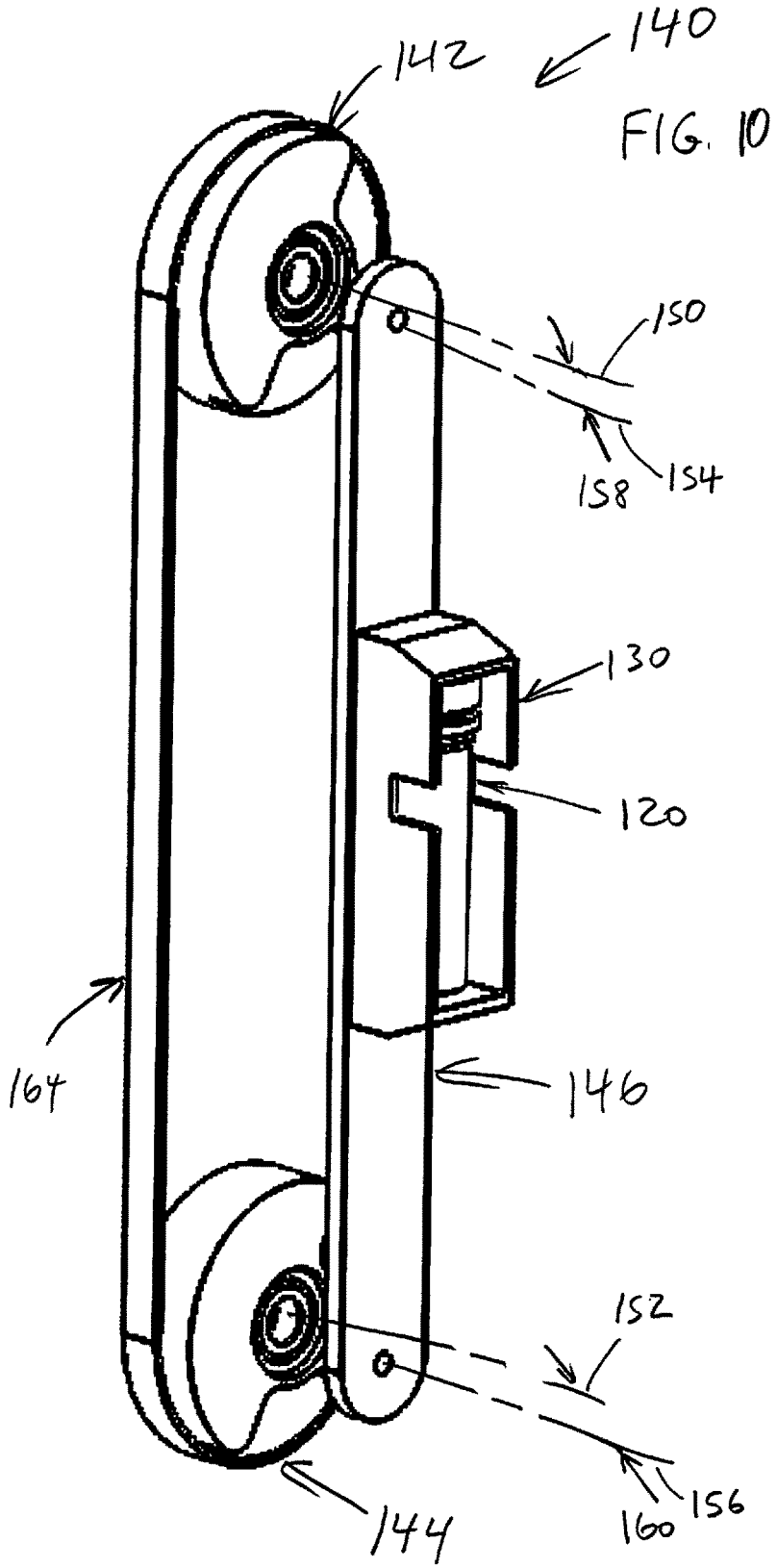
FIG. 10 is a perspective view of an agitation mechanism according to a second example embodiment of the present invention, showing a tube holder mounted to it and a sample-holding tube mounted to the tube holder.
Figure 11:
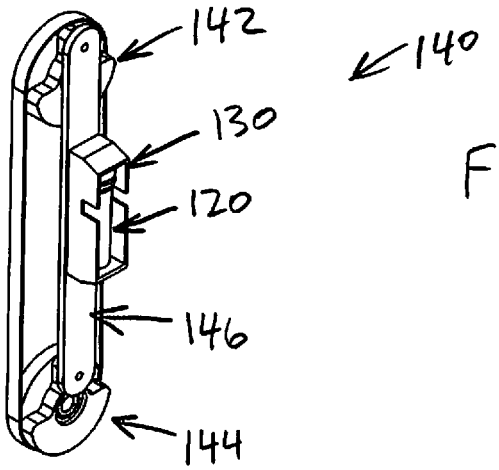
FIG. 11 shows the agitation mechanism of FIG. 10 in use with the crank member in a 12 o'clock position.
Figure 12:
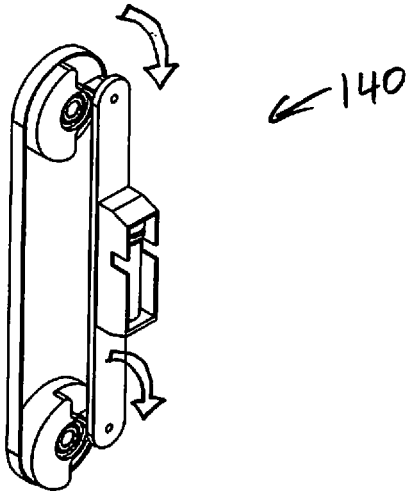
FIG. 12 shows the agitation mechanism of FIG. 11 in use with the crank member rotated to a 3 o'clock position.
Figure 13:
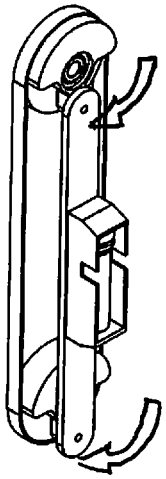
FIG. 13 shows the agitation mechanism of FIG. 12 in use with the crank member rotated further to a 6 o'clock position.
Figure 14:
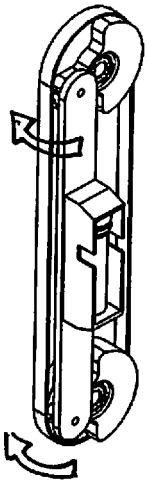
FIG. 14 shows the agitation mechanism of FIG. 13 in use with the crank member rotated further to a 9 o'clock position.
Figure 15:
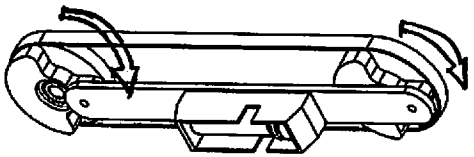
FIG. 15 shows the agitation mechanism of FIG. 14 in use with the crank member rotated further back to the 12 o'clock position.
Figure 16:
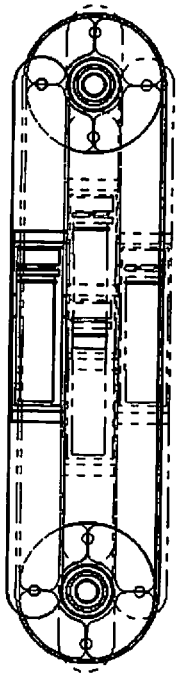
FIG. 16 is a side view of the agitation mechanism of FIG. 10, with the four positions of FIGS. 11-15 shown in phantom lines.
Figure 17:
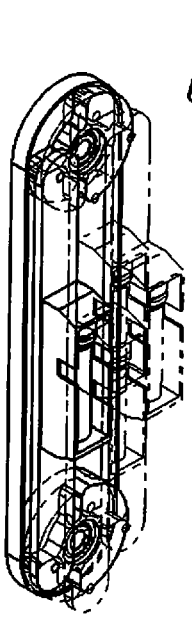
FIG. 17 is a perspective view of the agitation mechanism of FIG. 16.
Figure 18:
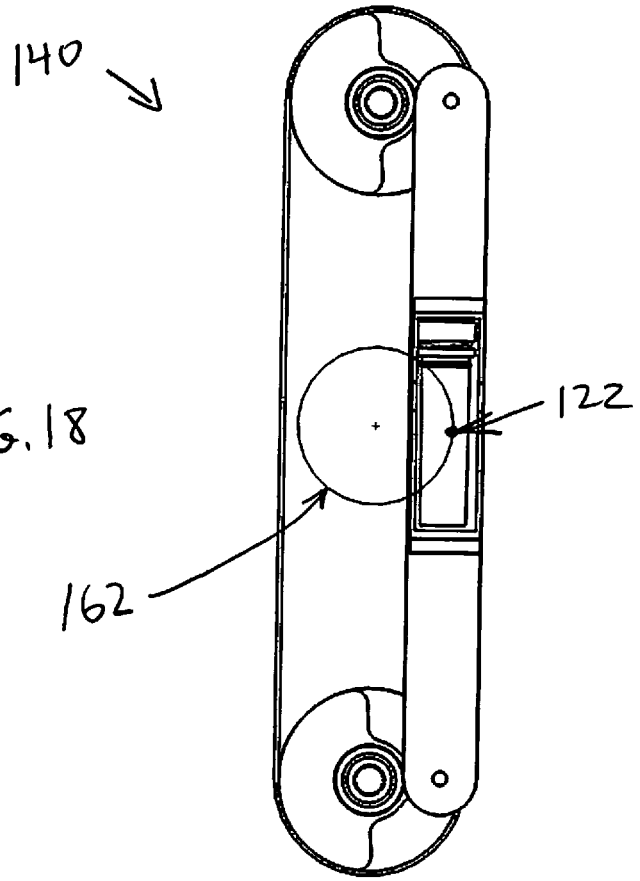
FIG. 18 is a side view of the agitation mechanism of FIG. 10, showing a motion profile traced as a centroid of the tube moves through the four positions of FIG. 16.
Figure 19:
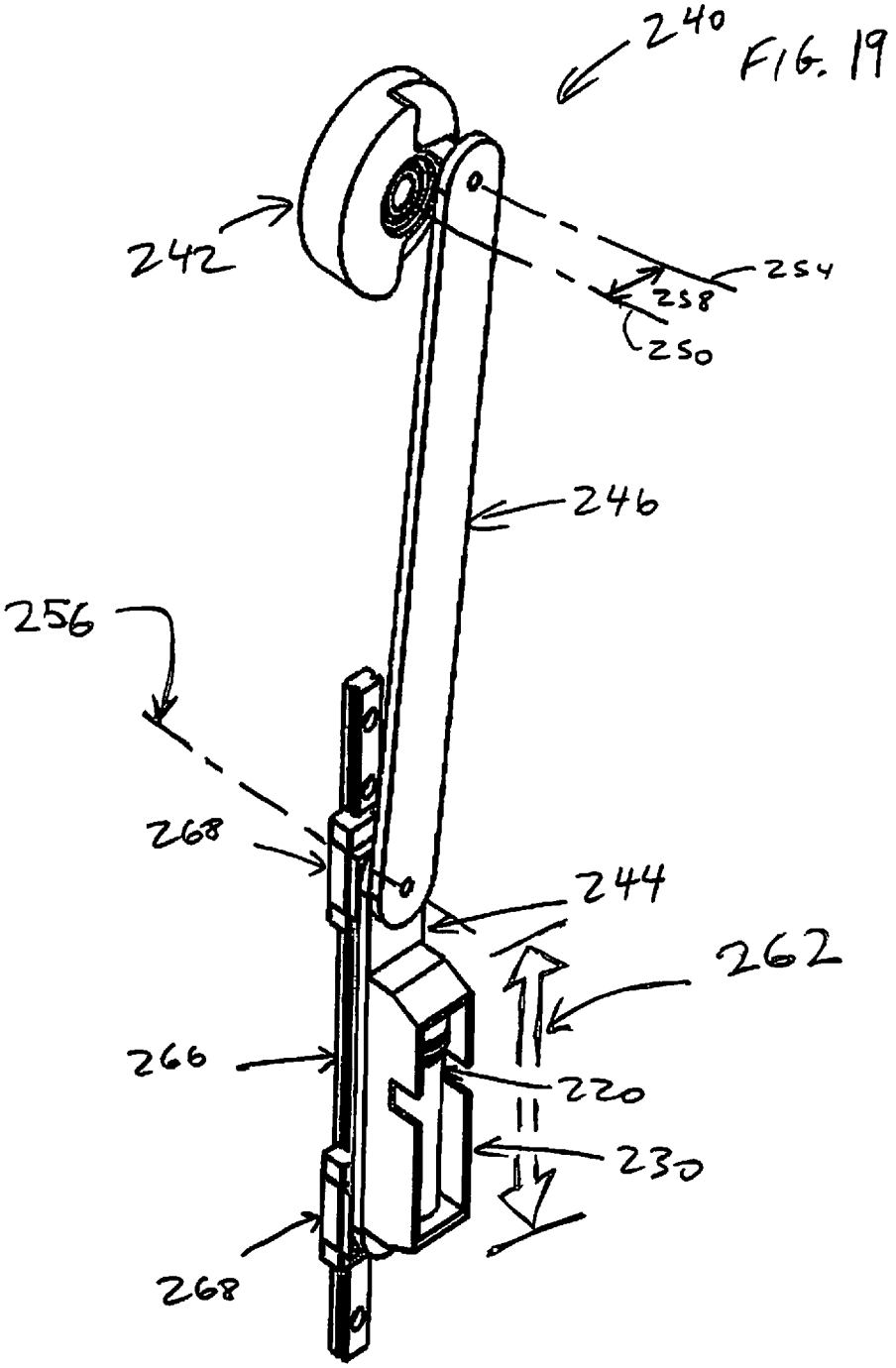
FIG. 19 is a perspective view of an agitation mechanism according to a third example embodiment of the present invention, showing a tube holder mounted to it and a sample-holding tube mounted to the tube holder.
Figure 20:
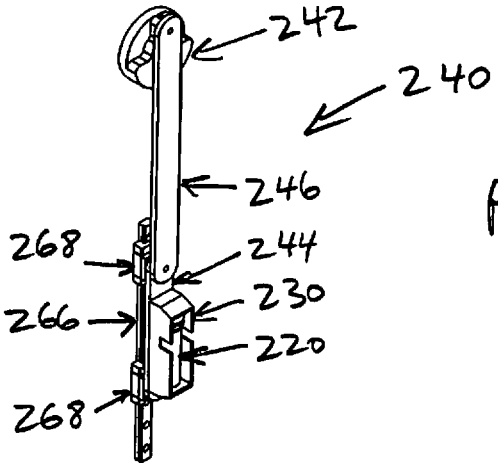
FIG. 20 shows the agitation mechanism of FIG. 19 in use with the crank member in a 12 o'clock position.
Figure 21:
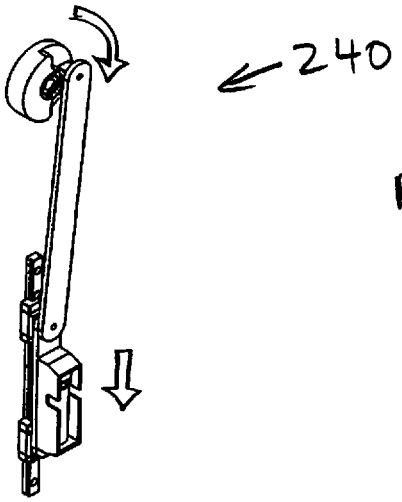
FIG. 21 shows the agitation mechanism of FIG. 20 in use with the crank member rotated to a 3 o'clock position.
Figure 22:
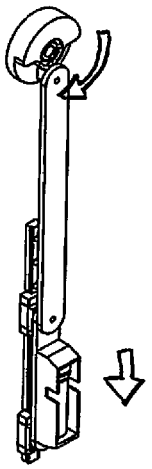
FIG. 22 shows the agitation mechanism of FIG. 21 in use with the crank member rotated further to a 6 o'clock position.
Figure 23:
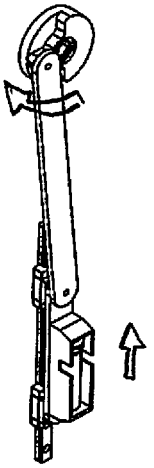
FIG. 23 shows the agitation mechanism of FIG. 22 in use with the crank member rotated further to a 9 o'clock position.
Figure 24:
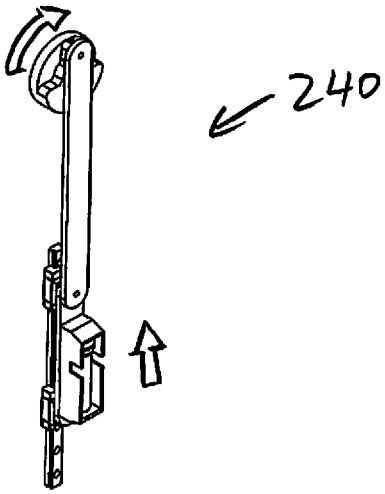
FIG. 24 shows the agitation mechanism of FIG. 23 in use with the crank member rotated further back to the 12 o'clock position.
Figure 25:
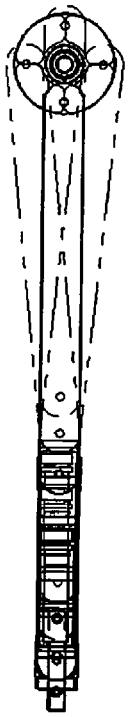
FIG. 25 is a side view of the agitation mechanism of FIG. 19, with the four positions of FIGS. 20-23 shown in phantom lines.
Figure 26:
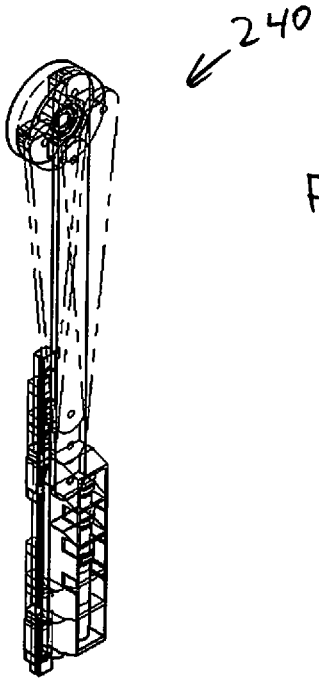
FIG. 26 is a perspective view of the agitation mechanism of FIG. 25.

It should be noted that the tube holder 30, and thus the tube 20 and its centroid 22, can be located at other positions on the connecting arm 46 to produce different agitation motion profiles. For example, with the tube holder and the tube (and thus the tube centroid) positioned closer to the crank wheel, the corresponding motion profile produced is less elliptical (less vertically/longitudinally elongated, relatively speaking) and more circular, and with them positioned closer to the rocker arm, the corresponding motion profile produced is more elliptical and less circular. In particular, with the tube holder and the tube positioned closer to the crank wheel to define alternative tube centroid 22*a* shown in FIG. 9A, the corresponding alternative motion profile 22*a* produced is generally circular (and thus transversely wider), and with them positioned closer to the rocker arm to define alternative tube centroid 22*b*, the corresponding alternative motion profile 22*b* produced is transversely narrower, while the length (vertical/longitudinal dimension) of the motion profiles is the same. (Because the rocker arm 44 pivots back and forth through a slight arc, the motion profiles 22 and 22*a* are rounder on the left side and flatter on the right side, with this being more exaggerated the closer the respective tube centroid 62 and 62 is to the rocker arm.) As such, the tube holder can be selectively located to generate a particular agitation motion profile as may be desired for a given application, for example to vary the amount of transverse motion of the tube centroid while keeping the amplitude in the tube axis/longitudinal direction the same.

FIGS. 10-18 show a nonlinearly reciprocating agitation mechanism 140 according to a second example embodiment of the invention. The agitation mechanism 140 is similar to that of the first embodiment, for example it can be readily incorporated into a conventional homogenization device (not shown), as is understood by persons of ordinary skill in the art, to transmit nonlinearly reciprocating motions and resulting forces through a tube holder 130 holding a tube 120 containing a sample material to homogenize the sample. In particular, the agitation mechanism 140 includes a first rotary member 142 with a first fixed rotational axis 150, a second rotary member 144 with a second fixed rotational axis 152, and a connecting member 146 that extends between them, that is rotationally coupled to the first and second rotary members (for example by a rotation-permitting pins) at third and fourth non-fixed rotational axes 154 and 156, respectively, and to which the tube holder 130 can be mounted.

In this embodiment, however, the first and second rotary members 142 and 144 have the same diameters of rotation. In other words, the third rotational axis 154 is offset from the first rotational axis 150 by the first offset 158, and the fourth rotational axis 156 is offset from the second rotational axis 152 by the second offset 160, with the first and second offsets being substantially equal. In this way, the third and fourth rotational axes 154 and 156 curve through a complete 360-degree path around the first and second rotational axes 150 and 152, respectively, with a constant angular speed, while the sample in the tube 120 is subjected to cyclically increasing and decreasing angular speeds (and resulting acceleration and deceleration forces) due to mechanically imparted forces during the vertical-component reciprocation (i.e., an acceleration force with a constant magnitude in a alternating/changing direction).

In addition, in this embodiment the first rotary member 142 is a crank wheel, the second rotary member 144 is an idler wheel, and the agitation system 140 includes a synchronization loop element (e.g., a belt or chain) 164 that is routed around the crank and idler wheels to coordinate their angular motion.

FIGS. 11-15 show the use of the agitation mechanism 140 of the homogenization device to process a sample material in one cycle of reciprocation, with the crank member 142 being driven through a complete 360-degree rotational cycle (as indicated by the upper angular directional arrows) from the 12 o'clock position (FIG. 11), to the 3 o'clock position (FIG. 12), to the 6 o'clock position (FIG. 13), to the 9 o'clock position (FIG. 14), and back to the 12 o'clock position (FIG. 15) to drive the idler member 144 through its rotational motion (as indicated by the lower angular directional arrows). And FIGS. 16 and 17 each show this same one cycle of reciprocation in one view (so the four positions shown in phantom lines in each of FIGS. 16 and 17 correspond to the four positions of FIGS. 11/15, 12, 13 and 14).

In particular, the control system is operated to rotate the drive shaft of the drive system, which in turn rotates the crank wheel 142 of the agitation mechanism 140. This rotation is transmitted from the crank wheel 142 to the idler wheel 144 through the connection arm linkage 146 as well as through the synchronization loop 164. The synchronized motion of the crank and idler wheels 142 and 144 propels the connection arm linkage 146 in such a way that the sample tube 120 is always parallel to a plane perpendicular to the rotational axes 150 and 152 of the crank and idler wheels. As the crank and idler wheels 142 and 144 rotate, the connection arm linkage 146 rotates in a circle to create the depicted nonlinear, reciprocating, planar motion profile 162 (see FIG. 18) for a centroid 122 (and top and bottom) of the tube 120 in the tube holder 130. As a result, the motion profile 162 of the tube centroid 122 is substantially circular, and thus symmetrical about the longitudinal and transverse axes of the tube 120. As such, the agitation mechanism 140 advantageously uses a planar quadrilateral linkage system with four rotating joints 150, 152, 154, and 156 to define this unique motion profile 162 with a non-linear path of motion that provides for improved grinding characteristics and increased acceleration forces for more-effective processing.

FIGS. 19-26 show a linearly reciprocating agitation mechanism 240 according to a third example embodiment of the invention. The agitation mechanism 240 has some similarities to that of the first embodiment, for example it can be readily incorporated into a conventional homogenization device (not shown), as is understood by persons of ordinary skill in the art, to transmit reciprocating motions and resulting forces through a tube holder 230 holding a tube 220 containing a sample material to homogenize the sample. In particular, the agitation mechanism 240 includes a first rotary member 242 with a fixed rotational axis 250, and a connecting member 246 that is rotationally coupled to the first rotary member at a non-fixed rotational axis 254 to define an offset 258 for using rotational motion to guide the tube holder 230 through a reciprocating processing motion.

In this embodiment, however, the second member 244 linearly reciprocates to guide the tube holder 230 and thus the tube 220 through a linearly reciprocating motion profile 262. As such, this embodiment does not provide the advantages of the nonlinear, reciprocating, planar motion profiles described above, and instead represents an improved agitation mechanism that converts a rotational drive motion to a linear reciprocating processing motion. In particular, the second member 244 is a slide carriage that is rotationally coupled to the connecting member 246 (for example by a rotation-permitting pin) at a non-fixed rotational axis 256 and that linearly reciprocates along a linear slide guide 266 and is linearly guided by one or more sliders 268. For example, in the depicted embodiment the slide guide 266 is in the form of a male member (e.g., a rail) and there are two sliders 268 in the form of female members (e.g., slide receivers) that slidingly receive the male rail member. In other embodiments, these slide guide is a female member and the slider is a male member slidingly received in the female member. And the tube holder 230 is fixedly mounted to and moves with the slide carriage 244.

FIGS. 20-24 show the use of the agitation mechanism 240 of the homogenization device to process a sample material in one cycle of reciprocation, with the crank member 242 being driven through a complete 360-degree rotational cycle (as indicated by the upper angular directional arrows) from the 12 o'clock position (FIG. 20), to the 3 o'clock position (FIG. 21), to the 6 o'clock position (FIG. 22), to the 9 o'clock position (FIG. 23), and back to the 12 o'clock position (FIG. 24) to drive the slide carriage 244 through its translational motion (as indicated by the lower angular directional arrows). And FIGS. 25 and 26 each show this same one cycle of reciprocation in one view (so the four positions shown in phantom lines in each of FIGS. 25 and 26 correspond to the four positions of FIGS. 20/24, 21, 22 and 23).

In particular, the control system is operated to rotate the drive shaft of the drive system, which in turn rotates the crank wheel 242 of the agitation mechanism 240. The slide carriage 244 being rotationally mounted to the slider unit(s) 268, which slidingly engage the linear slide guide component 266, converts this rotation to a linear reciprocating (e.g., up-and-down) motion of the slide carriage (and thus the attached sample tube 220) parallel to the linear slide guide and between two travel end-points. Thus, when the crank wheel 242 rotates, the slide carriage 244 slides in a line to create the depicted linear, reciprocating, planar motion profile for a centroid (and top and bottom) of the tube 220 in the tube holder 230. As such, the agitation mechanism 240 advantageously uses a piston-like mechanism to create a purely linear motion profile that creates impact forces for more-effective processing with less grinding.

In another embodiment (not shown), a linearly reciprocating agitation mechanism is similar to that of the third example embodiment disclosed herein, except that the slide carriage and the connecting member are combined into a single part. As such, the slide carriage can be considered to be eliminated in this embodiment, with the tube holder mounted to the connecting member (just not immediately adjacent the crank member) and with the connecting member slidingly mounted to the linear slide guide by one or more sliders.

In yet another embodiment (not shown), a nonlinearly reciprocating agitation mechanism is similar to that of the third example embodiment disclosed herein, except that the slide carriage is slidingly mounted to the linear slide guide so that the carriage reciprocates along the slide guide but is not limited to linear motion. For example, the slide carriage can be slidingly mounted to the slide guide by being rotationally coupled to a single slider that is positioned at a lower portion of the carriage (e.g., its bottom end) to permit rotational motion between the carriage and the slider. And the slide carriage can be rotationally coupled to the connection arm at an upper portion of the carriage (e.g., at its top end) to permit rotational motion between the carriage and the connecting arm. So the lower portion of the carriage (at the rotational mount to the linearly guided slider) linearly reciprocates and the upper portion of the carriage (at the rotational mount to the rotationally driven connecting member) is free to rock laterally in a side-to-side manner. As such, this embodiment provides the advantages of the nonlinear, reciprocating, planar (e.g., teardrop/egg-shaped) motion profile described above.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. An agitation mechanism for a laboratory homogenization device for homogenizing a sample in a laboratory tube removably secured in place by a laboratory tube holder, comprising:

a first rotary member having a first fixed rotational axis about which it rotates;

a second rotary member having a second fixed rotational axis about which it rotates;

a connecting member that extends between the first and second rotary members and that is rotationally mounted to the first and second rotary members at respective third and fourth non-fixed rotational axes; and a mounting location where the laboratory tube holder is positioned, wherein the first and third rotational axes define a first radial offset and the second and fourth rotational axes define a second radial offset to cooperatively produce a nonlinearly reciprocating motion profile for a centroid of the laboratory tube in the laboratory tube holder, and wherein the nonlinearly reciprocating motion profile produces nonlinearly reciprocating forces on the sample in the laboratory tube that cause the sample to reciprocating move not just longitudinally along lengths of the laboratory tube but also transversely between sides of the laboratory tube to produce a grinding shear action to homogenize the sample, and wherein the first offset is smaller than the second offset so that the third rotational axis of the first rotary member travels through a complete 360-degree path around the first rotational axis, and in response thereto the fourth rotational axis sweeps in a nonlinear reciprocating motion through an arc that is radiused from the second rotational axis, wherein the tube-centroid motion profile is not symmetrical about an axis transverse to a longitudinal axis of the tube and instead is generally oval or teardrop-shaped.

2. The agitation mechanism of claim 1, wherein the third rotational axis of the first rotary member travels through the complete 360-degree path around the first rotational axis with a constant angular speed, and in response thereto the fourth rotational axis sweeps in the nonlinear reciprocating motion through the arc radiused from the second rotational axis at cyclically increasing and decreasing angular speeds.

3. The agitation mechanism of claim 1, wherein the first rotary member is a crank wheel and the second rotary member is a rocker link arm.

4. The agitation mechanism of claim 1, wherein the tube-holder mounting location is on the connecting member so that the laboratory tube holder moves along with the connecting member.

5. The agitation mechanism of claim 4, wherein the laboratory tube holder holds the tube in a parallel plane to the connecting member so that the tube-centroid motion profile is planar.

6. The agitation mechanism of claim 1, wherein the laboratory homogenization device includes a drive system with a drive shaft, and wherein the first rotary member is operably coupled to and driven by the drive shaft.

7. An agitation mechanism for a laboratory homogenization device for homogenizing a sample in a laboratory tube removably secured in place by a laboratory tube holder, comprising:

a first rotary member having a first fixed rotational axis about which it rotates, wherein the first rotary member is a crank wheel, and wherein the first rotary member is operably coupled to and driven by a drive shaft of the laboratory homogenization device;

a second rotary member having a second fixed rotational axis about which it rotates, wherein the second rotational axis is defined by a pin mounted to the laboratory homogenization device;

a connecting member that extends between the first and second rotary members and that is rotationally mounted to the first and second rotary members at respective third and fourth non-fixed rotational axes; and a mounting location where the laboratory tube holder is positioned, wherein the tube-holder mounting location is on the connecting member so that the laboratory tube holder moves along with the connecting member, wherein the first and third rotational axes define a first radial offset and the second and fourth rotational axes define a second radial offset to cooperatively produce a nonlinearly reciprocating motion profile for a centroid of the laboratory tube in the laboratory tube holder, wherein the first offset and the second offset are not equal so that the tube-centroid motion profile is not symmetrical about an axis transverse to a longitudinal axis of the laboratory tube, wherein the laboratory tube holder holds the laboratory tube in a parallel plane to the connecting member so that the tube-centroid motion profile is planar, and wherein the nonlinearly reciprocating motion profile produces nonlinearly reciprocating forces on the sample in the laboratory tube that cause the sample to reciprocating move not just longitudinally along lengths of the laboratory tube but also transversely between sides of the laboratory tube to produce a grinding shear action to homogenize the sample, and wherein the first offset is smaller than the second offset so that the third rotational axis of the first rotary member travels through a complete 360-degree path around the first rotational axis with a constant angular speed, and in response thereto the fourth rotational axis sweeps in a nonlinear reciprocating motion through an arc that is radiused from the second rotational axis and at cyclically increasing and decreasing angular speeds, wherein the tube-centroid motion profile is generally oval or teardrop-shaped.

8. The agitation mechanism of claim 1, wherein the laboratory homogenization device includes a drive system with a drive shaft, and wherein the first rotary member is operably coupled to and driven by the drive shaft.

9. A laboratory homogenization device for homogenizing a sample in a laboratory tube, the laboratory homogenization device comprising:

a drive system including with a drive shaft and a motor that drives the drive shaft; and an agitation mechanism for processing the sample in the laboratory tube, the agitation mechanism comprising:

a first rotary member having a first fixed rotational axis about which it rotates, wherein the first rotary member is operably coupled to and rotationally driven about the first fixed rotational axis by the drive shaft;

a second rotary member having a second fixed rotational axis about which it rotates, wherein the second rotational axis is defined by a pivotal mount to the laboratory homogenization device;

a connecting member that extends between the first and second rotary members and that is rotationally mounted to the first and second rotary members at respective third and fourth non-fixed rotational axes; and a laboratory tube holder that removably secures the laboratory tube in place, wherein the tube holder is positioned on the connecting member so that the tube holder moves along with the connecting member, wherein the tube holder holds the laboratory tube in a parallel plane to the connecting member so that a motion profile of a centroid of the laboratory tube in the tube holder is planar, wherein the first and third rotational axes define a first radial offset and the second and fourth rotational axes define a second radial offset, wherein the first offset is smaller than the second offset so that the third rotational axis of the first rotary member travels through a complete 360-degree path around the first rotational axis, and in response thereto the fourth rotational axis sweeps in a nonlinear reciprocating motion through an arc that is radiused from the second rotational axis, wherein the tube-centroid motion profile is nonlinearly reciprocating, non-symmetrical about an axis transverse to a longitudinal axis of the tube, and generally oval or teardrop-shaped, and wherein the nonlinearly reciprocating motion profile produces nonlinearly reciprocating forces on the sample in the laboratory tube that cause the sample to reciprocatingly move not just longitudinally along lengths of the laboratory tube but also transversely between sides of the laboratory tube to produce a grinding shear action to homogenize the samples.

10. The laboratory homogenization device of claim 9, wherein the third rotational axis of the first rotary member travels through the complete 360-degree path around the first rotational axis with a constant angular speed, and in response thereto the fourth rotational axis sweeps in the nonlinear reciprocating motion through the arc radiused from the second rotational axis at cyclically increasing and decreasing angular speeds.

11. The laboratory homogenization device of claim 9, wherein the first rotary member is a crank wheel and the second rotary member is a rocker link arm.

* * * * *